US005546753A

United States Patent [19]

Yokogi

[11] Patent Number: 5,546,753

[45] Date of Patent: Aug. 20, 1996

[54] EVAPORATED GAS SUPPLY METHOD

[75] Inventor: Kazuo Yokogi, Tokyo, Japan

[73] Assignee: Teisan K.K., Tokyo, Japan

[21] Appl. No.: 361,389

[22] Filed: Dec. 22, 1994

[30] Foreign Application Priority Data

Dec. 27, 1993 [JP] Japan ..... 5-332355

[51] Int. Cl.[6] ..... F17C 7/04

[52] U.S. Cl. ..... 62/48.1; 62/50.2

[58] Field of Search ..... 62/48.1, 50.2

[56] References Cited

U.S. PATENT DOCUMENTS

| | | | |
|---|---|---|---|
| 3,121,999 | 2/1964 | Kasbohm et al. | 62/48.1 |
| 4,761,961 | 8/1988 | Marx | 62/50.2 |
| 4,878,510 | 11/1989 | Kasper et al. | 137/1 |

FOREIGN PATENT DOCUMENTS

| | | |
|---|---|---|
| JP-A-01 | 10/1989 | Japan . |
| 266400 | 10/1989 | Japan . |

*Primary Examiner*—Ronald C. Capossela
*Attorney, Agent, or Firm*—Burns, Doane, Swecker & Mathis

[57] ABSTRACT

An evaporated gas supply method in which the liquid seal of an evaporated gas can be effectively avoided, is provided. According to the present invention, there is provided an evaporated gas supply method in which an evaporated gas having a primary pressure filled in a cylinder is reduced in pressure to a secondary pressure through adiabatic expansion, and the evaporated gas having the secondary pressure is supplied to a predetermined consuming installation, and which comprises a step of cooling down an evaporated gas in a cylinder, whereby the enthalpy of the evaporated gas (2) filled in the said cylinder is increased over an enthalpy of the secondary pressure on the saturated vapor line in a pressure-enthalpy diagram of the same evaporated gas, and a step of adiabatically expanding the evaporated gas filled in the cylinder so that its pressure is reduced, and supplying the evaporated gas having the reduced pressure to said consuming installation.

6 Claims, 11 Drawing Sheets

EVAPORATED GAS SUPPLY METHOD

BACKGROUND OF THE INVENTION

1. Technical Field

The present invention related to an evaporated gas supply method in which an evaporated gas having a primary pressure filled in a cylinder is reduced in pressure to a secondary pressure through adiabatic expansion, and the evaporated gas having the secondary pressure is supplied to a predetermined consuming installation.

2. Prior Art

For the purpose of realizing a long-term supply of an evaporated gas in a case where the evaporated gas is supplied to a semiconductor manufacturing factory, such a conventional evaporated gas supply system has been used that the said evaporated gas is filled at a high-pressure condition (for example, 52 kg/cm$^2$.abs) in a cabinet cylinder, and it will be supplied after its pressure is reduced by an expansion valve.

Referring to FIG. 10 and FIG. 11, the evaporated gas supply system of the prior art will be described. FIG. 10 is a view showing the outline of a conventional evaporation and supply apparatus and FIG. 11 is a graph showing a change of pressure in an expansion valve.

In a cabinet cylinder 1, an evaporated gas 2 is filled at a high-pressure (primary pressure) condition. A pipe 4 is laid from this cabinet cylinder 1 to a consuming installation 3 such as a semiconductor manufacturing factory, and an expansion valve 5 is attached on the way thereof. By means of this expansion valve 5, the evaporated gas 2 in the cabinet cylinder 1 is reduced in pressure so as to provide the evaporated gas 2 having a low pressure (secondary pressure) usable in the consuming installation 3.

According to the evaporated gas supply method of the prior art, the evaporated gas 2 is being preserved in the cabinet cylinder 1 for a long period of time, and therefore, the evaporated gas 2 to be supplied gets in a saturated state or a state near thereto. If the evaporated gas 2 is supplied from such state by way of the expansion valve 5, a liquid seal will be caused to take place. For instance, in a case where 100% $N_2O$ having a primary pressure of 50 kg/cm$^2$ is led to the expansion valve 5 so that its pressure is reduced to a secondary pressure of 5 kg/cm$^2$, it will become $N_2O$ comprising 97% of gas and 3% of liquid. As a result, a liquid seal takes place, resulting in such a problem that the same evaporated gas 2 can not be supplied at a predetermined flow rate to the concuming installation 3.

It is an object of the presnt invention to provide an evaporated gas supply method in which the liquid seal of an evaporated gas can be prevented from taking place.

SUMMARY OF THE INVENTION

In order to achieve the aforementioned purpose, according to the present invention, there is provided an evaporated gas supply method in which an evaporated gas having a primary pressure filled in a cylinder is reduced in pressure to a secondary pressure through adiabatic expansion, and the evaporated gas having the secondary pressure is supplied to a predetermined consuming installation, and which comprises: a step of cooling down the evaporated gas in the cylinder, whereby the enthalpy of the evaporated gas filled in said cylinder is increased over an enthalpy of the secondary pressure on the saturated vapor line in a pressure-enthalpy diagram of the same evaporated gas; and a step of adiabatically expanding the evaporated gas filled in the cylinder so that its pressure is reduced, and supplying the evaporated gas having the reduced pressure to said consuming installation.

DESCRIPTION OF REFERENCE NUMERALS

Figure 1:
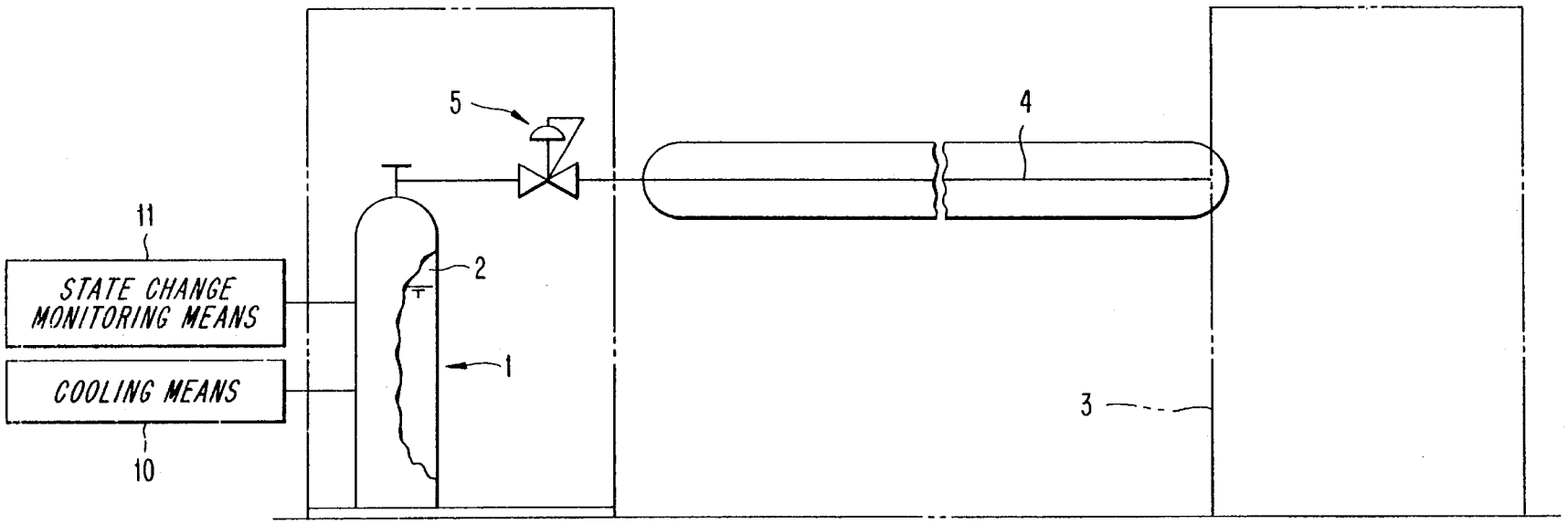
FIG. 1 is a schematic view showing the evaporated gas supply system according to one preferred embodiment of the present invention.

1—cabinet cylinder, 2—evaporated gas, 3—consuming installation, 4—pipe, 5—expansion valve, 10—cooling means, 11—state change monitoring means.

DETAILED DESCRIPTION OF THE PREFERRED EMBODIMENTS

Since the present invention is constructed as mentioned above, an evaporated gas filled in a cylinder is cooled down before it is adiabatically expanded so that its enthalpy becomes at least an enthalpy at the secondary pressure on the saturated vapor line. If this evaporated gas is adiabatically expanded, its pressure will be reduced to a secondary pressure, but no liquefaction is caused to take place at the secondary pressure for supply to the consuming installation because the adiabatically expanded evaporated gas has already obtained the enthalpy at the secondary pressure on the saturated vapor line. Thus, its liquid seal can be prevented from taking place.

EMBODIMENT

Referring to the accompanying drawings, the evaporated gas supply method according to one preferred embodiment of the present invention will be described. The same reference numerals are used for the same elements and the duplicate explanations will be omitted.

Figure 2:
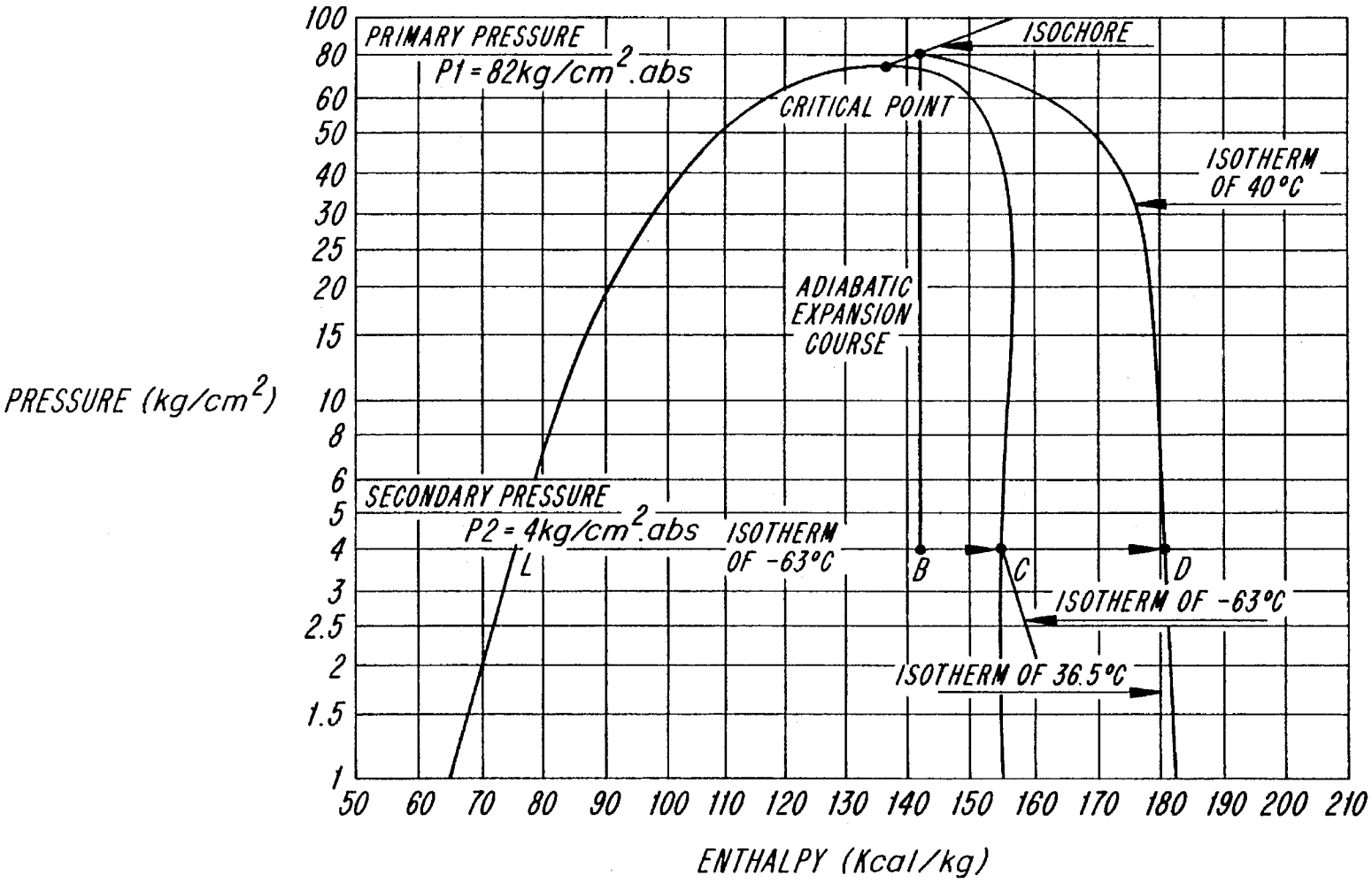
FIG. 2 is a view showing a change of state when $N_2O$ filled in a cabinet cylinder 1 whose internal temperature is 40° C. is reduced in pressure from P1=82 kg/cm$^2$.abs (Point A) to P2=4 kg/cm$^2$.abs (Point B) by an expansion valve 5.

The principle of the present invention will be first described in accordance with FIGS. 2 to 8. Each of FIGS. 2 to 8 is a pressure-enthalpy diagram of $N_2O$ showing a change of state where its pressure is reduced from a primary pressure P1 to a secondary pressure P2=4 kg/cm$^2$.abs. As to the primary pressures P1, FIG. 2 shows P1=82 kg/cm$^2$.abs, FIG. 3: P1=74 kg/cm$^2$.abs, FIG. 4: P1=64 kg/cm$^2$.abs, FIG. 5: P1=52 kg/cm$^2$.abs, FIG. 6: P1.=43 kg/cm$^2$.abs, FIG. 7: P1=34 kg/cm$^2$.abs and FIG. 8: P1=25 kg/cm$^2$.abs, respectively.

In FIG. 2, a change of state is shown when $N_2O$ filled in a cabinet cylinder 1 whose internal temperature is 40° C. is reduced in pressure from P1=82 kg/cm$^2$.abs (Point A) to P2=4 kg/cm$^2$.abs (Point B) by an expansion valve 5. In this case, the temperature of $N_2O$ caused by its adiabatic expansion in the pressure reduction is lowered to about −63° C. and about 18% of the gas is liquefied.

Figure 3:
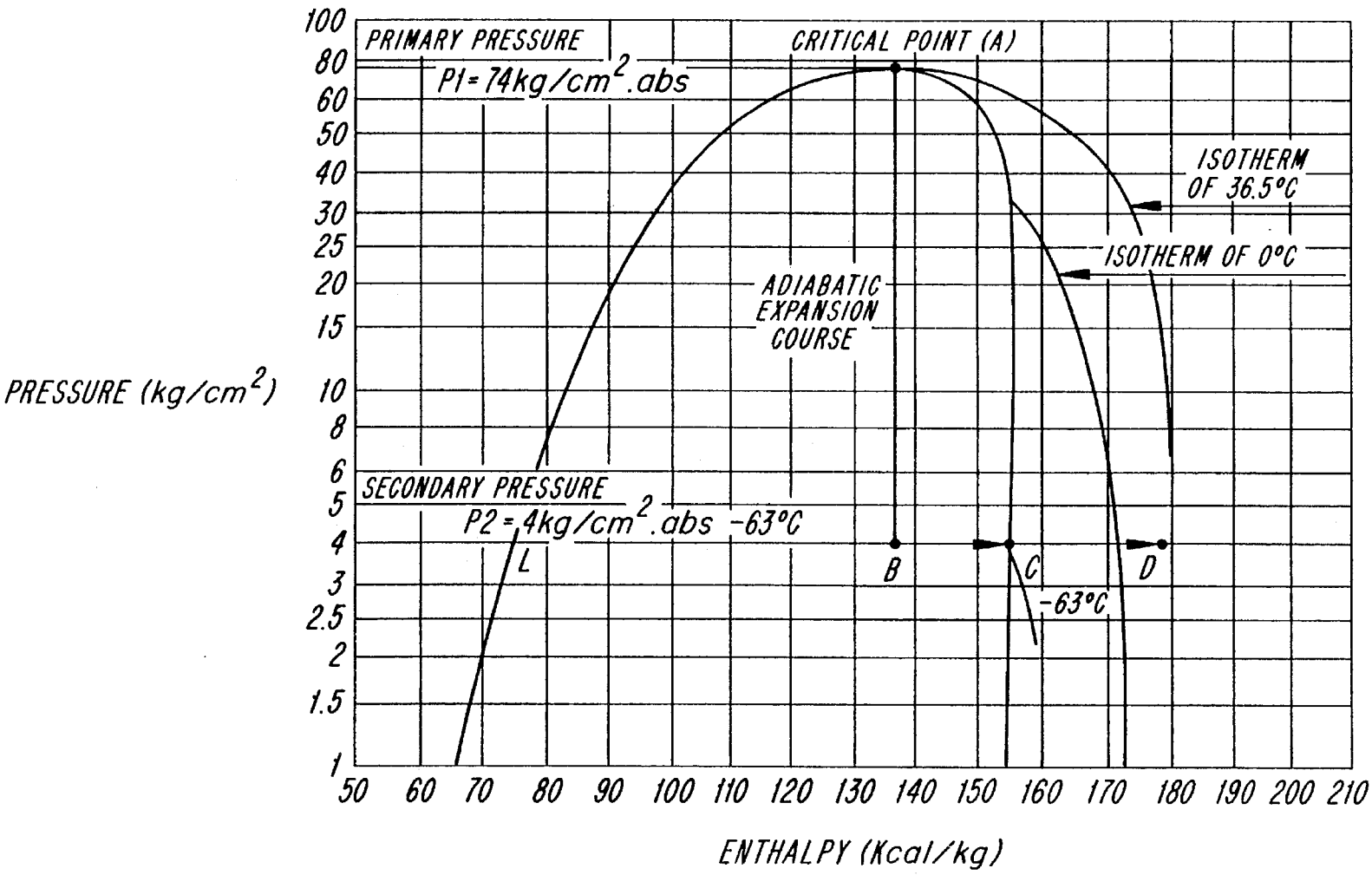
FIG. 3 is a view showing a change of state when $N_2O$ filled in a cabinet cylinder 1 whose internal temperature is 36.5° C., the critical temperature of $N_2O$, is reduced in pressure from P1=74 kg/cm$^2$.abs (Point A) to P2=4 kg/cm$^2$.abs (Point B) by an expansion valve 5.

FIG. 3 shows a change of state when $N_2O$ filled in a cabinet cylinder 1 whose internal temperature is 36.5° C., this is the critical temperature of $N_2O$, is reduced in pressure from P1=74 kg/cm$^2$.abs (Point A) to P2=4 kg/cm$^2$.abs (Point B) by an expansion valve 5. In this case, the temperature of $N_2O$ caused by its adiabatic expansion in the pressure reduction is lowered to about −63° C. and about 22% of the gas is liquefied.

Figure 4:
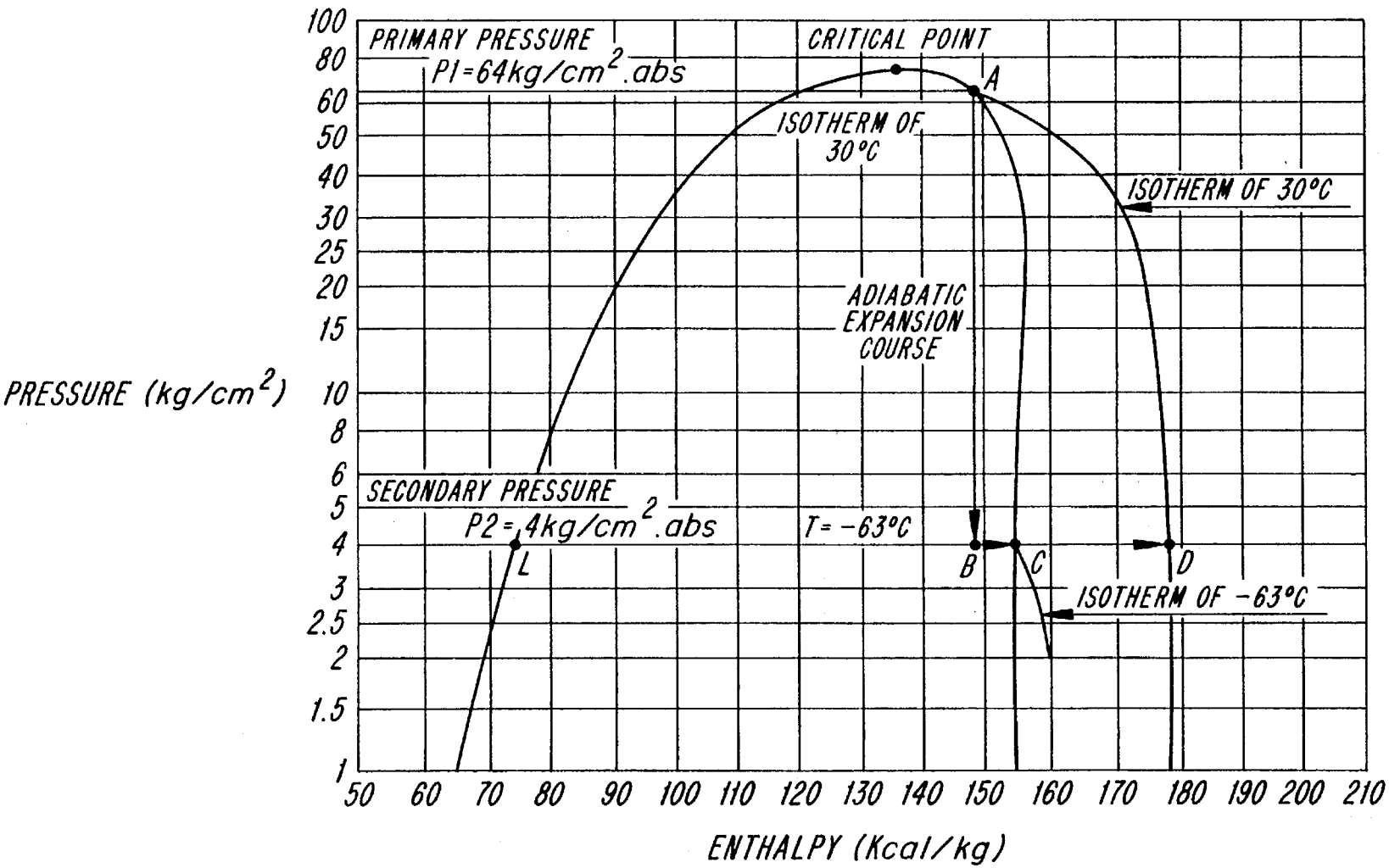
FIG. 4 is a view showing a change of state when $N_2O$ filled in a cabinet cylinder 1 whose internal temperature is 30° C. is reduced in pressure from P1=64 kg/cm$^2$.abs (Point A) to P2=4 kg/cm$^2$.abs (point B) by an expansion valve 5.

FIG. 4 shows a change of state when $N_2O$ filled in a cabinet cylinder 1 whose internal temperature is 30° C. is reduced in pressure from P1=64 kg/cm$^2$.abs (Point A) to P2=4 kg/cm$^2$.abs (Point B) by an expansion valve 5. In this case, the temperature of $N_2O$ caused by its adiabatic expansion in the pressure reduction is lowered to about −63° C. and about 10% of the gas is liquefied.

Figure 5:
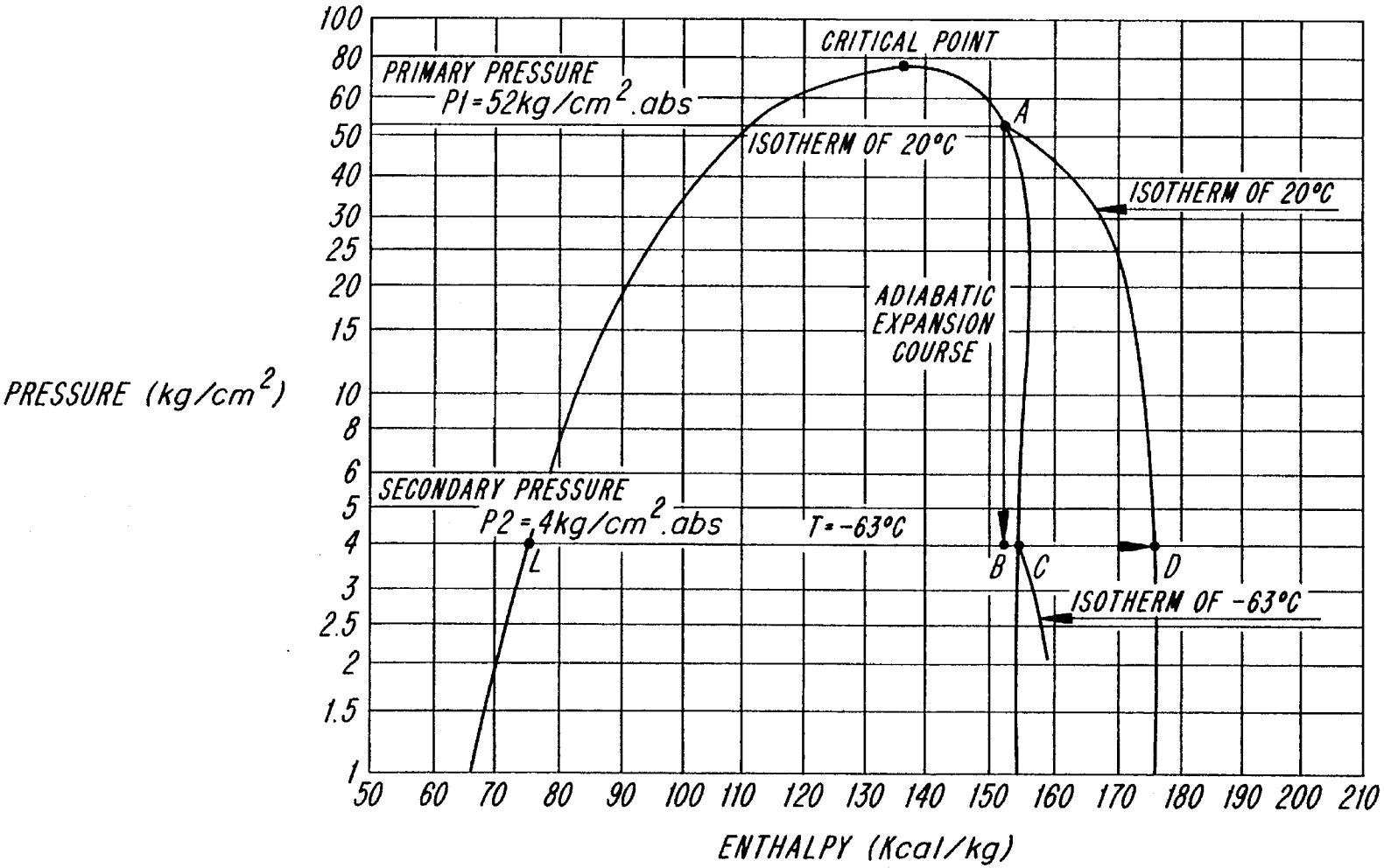
FIG. 5 is a view showing a change of state when $N_2O$ filled in a cabinet cylinder 1 whose internal temperature is 20° C. is reduced in pressure from P1=52 kg/cm$^2$.abs (Point A) to P2=4 kg/cm$^2$.abs (Point B) by an expansion valve 5.

In FIG. 5, a change of state is shown when $N_2O$ filled in a cabinet cylinder 1 whose internal temperature is 20° C. is reduced in pressure from P1=52 kg/cm$^2$.abs (Point A) to P2=4 kg/cm$^2$.abs (Point B) by an expansion valve 5. In this case, the temperature of $N_2O$ caused by its adiabatic expansion in the pressure reduction is lowered to about −63° C. and about 3% of the gas is liquefied.

Figure 6:
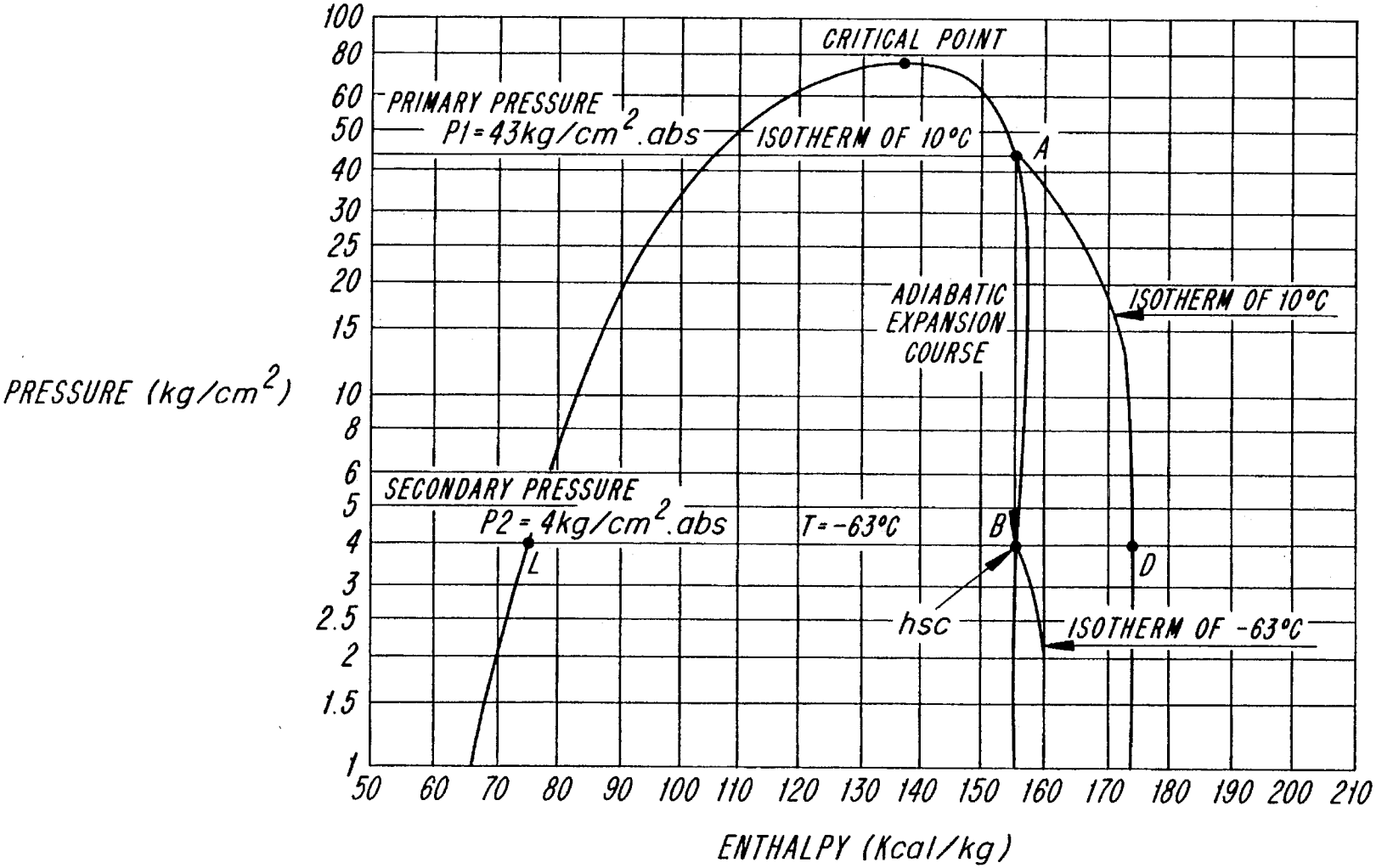
FIG. 6 is a view showing a change of state when $N_2O$ filled in a cabinet cylinder 1 whose internal temperature is 10° C. is reduced in pressure from P1=43 kg/cm$^2$.abs (Point A) to P2=4 kg/cm$^2$.abs (Point B) by an expansion valve 5.

FIG. 6 shows a change of state when $N_2O$ filled in a cabinet cylinder 1 whose internal temperature is 10° C. is reduced in pressure from P1=43 kg/cm$^2$.abs (Point A) to P2=4 kg/cm$^2$.abs (Point B) by an expansion valve 5. In this case, the temperature of $N_2O$ caused by its adiabatic expansion in the pressure reduction is lowered to about −63° C., but the gas is not liquefied even by the adiabatic expansion because Point B is on the saturated vapor line (a critical line of saturation). For facilitating the explanation, in addition, the enthalpy on the critical line of saturation at P2=4 kg/cm$^2$.abs will be hereinafter defined as "the saturation critical enthalpy (=$h_{2SC}$)".

Figure 7:
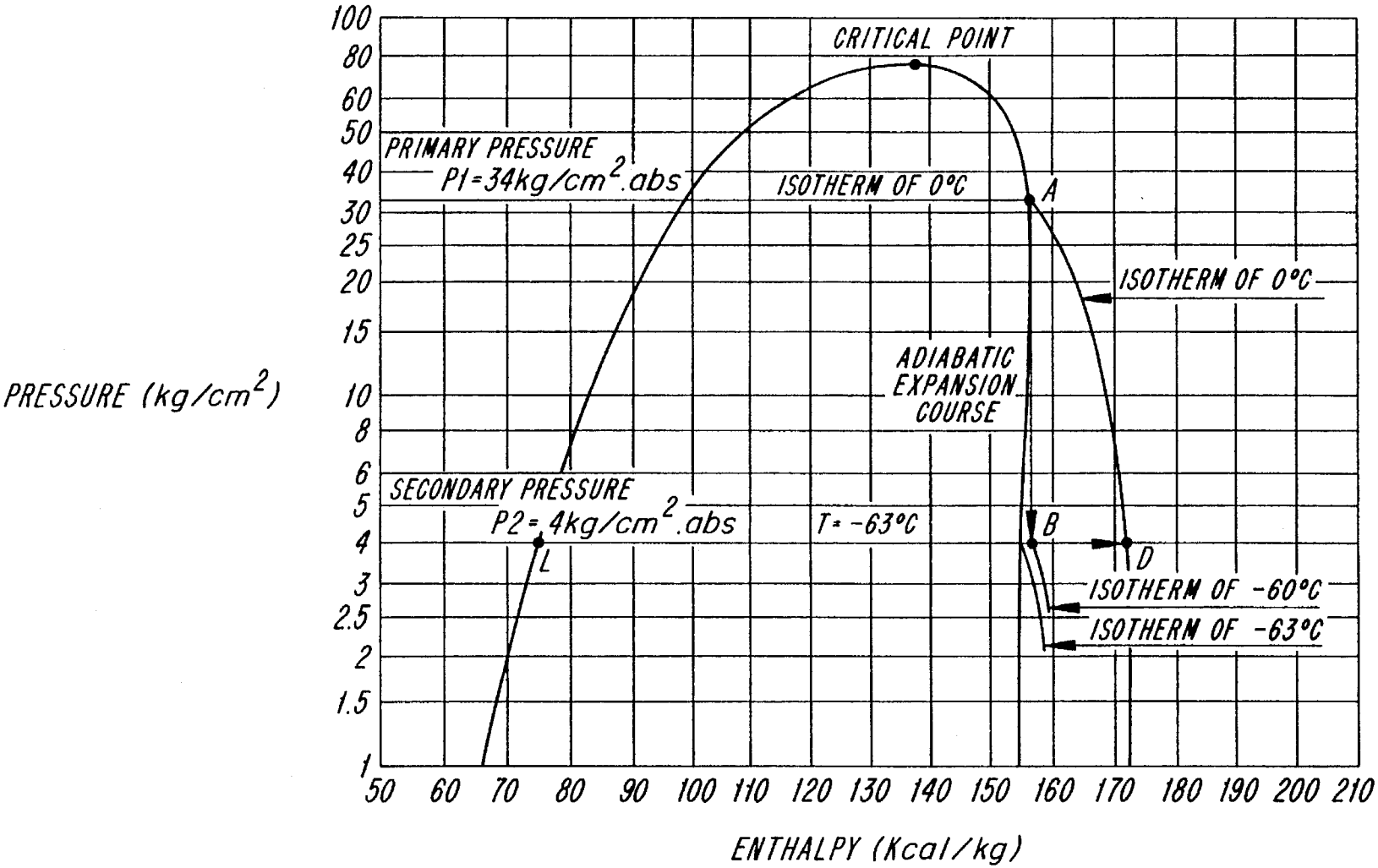
FIG. 7 is a view showing a change of state when $N_2O$ filled in a cabinet cylinder 1 whose internal temperature is 0° C. is reduced in pressure from P1=34 kg/cm$^2$.abs (Point A) to P2=4 kg/cm$^2$.abs (Point B) by an expansion valve 5.

FIG. 7 shows a change of state when $N_2O$ filled in a cabinet cylinder 1 whose internal temperature is 0° C. is reduced in pressure from P1=34 kg/cm$^2$.abs (Point A) to P2=4 kg/cm$^2$.abs (Point B) by an expansion valve 5. In this case, the temperature of $N_2O$ caused by its adiabatic expansion in the pressure reduction is lowered to about −60° C., but the gas is not liquefied even by the adiabatic expansion because Point B is right of the critical line of saturation, namely it is in a state of superheated vapor.

Figure 8:
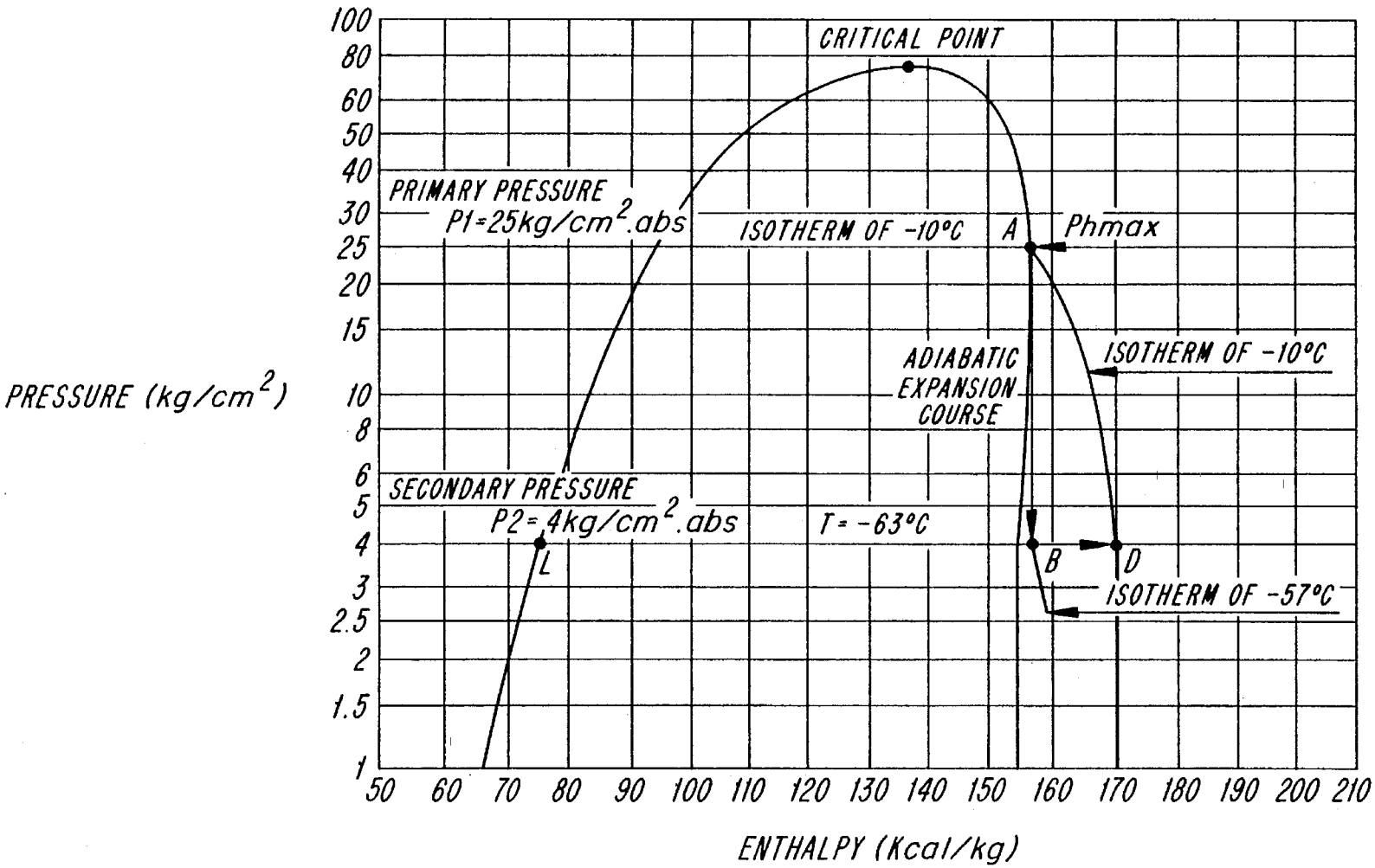
FIG. 8 is a view showing a change of state when $N_2O$ filled in a cabinet cylinder 1 whose internal temperature is −10° C. is reduced in pressure from P1=25 kg/cm$^2$.abs (Point A) to P2=4 kg/cm$^2$.abs (Point B) by an expansion valve 5.

In FIG. 8, furthermore, a change of state is shown when $N_2O$ filled in a cabinet cylinder 1 whose internal tempeature is −10° C. is reduced in pressure from P1=25 kg/cm$^2$.abs (Point A) to P2=4 kg/cm$^2$.abs (Point B) by an expansion valve 5. In this case, the temperature of $N_2O$ caused by its adiabatic expansion in the pressure reduction is lowered to about −57 C., but no liquefaction of the gas is absolutly caused to take place in the expansion valve 5 bacause both the adiabatic expansion course and Point B are right of the critical line of saturation. In addition, P1=25 kg/cm.abs exhibits the maximum enthalpy on the critical line of saturation, and for facilitating the explanation, this pressure will be hereinafter defined as the maximum enthalpy pressure (=$P_{hmax}$).

From these inventor's data obtained as mentioned above, the inventor has discovered:

① If the sate of the evaporated gas 2 fed from the cabinet cylinder 1 to the expansion valve 5 is kept in anyone of the states shown in FIG. 6, FIG. 7 and FIG. 8, the liquefaction of the evaporated gas 2 in the expansion valve 5 can be prevented from taking place; and ② In order that the state of the evaporated gas 2 is transferred from the state shown in FIG. 2, FIG. 3, FIG. 4 or FIG. 5 to the state shown in FIG. 6, FIG. 7 or FIG. 8, this transfer can be satisfctorily carried out by cooling down the evaporated gas 2.

The discovery ① is based on the adiabatic expansion courses shown in FIGS. 2 to 8 and the discovery ② is based on the positional relations of the isotherms depicted in FIGS. 2 to 8.

Referring to FIG. 1, in the next place, the evaporated gas supply system which the inventor has invented will be described.

FIG. 1 is a schematic view showing the evaporated gas supply system according to one preferred embodiment of the present invention. The differences between the evaporated gas supply system according to the present invention and that of the prior art are the addition of a cooling means 10 to the cabinet cylinder 1 and the provision of a state change monitoring means which can detect a physical quantity (such as pressure or temperature) capable of specifying the state of the evaporated gas filled in the cabinet cylinder 1.

In the cabinet cylinder 1, an evaporated gas 2 is filled in a high-pressure (primary pressure) condition, as mentioned above. So, a portion of the evaporated gas 2 gets liquefied. From this cabinet cylinder 1, a pipe 4 is laid to a consuming installation 3, for instance a semiconductor manufacturing factory, and an expansion valve 5 is attached on the way of said pipe 4. The pipe 4 is covered with a heat insulating material for insulation of heat from the out side. By means of this expansion valve 5, the evaporated gas 2 in the cabinet cylinder 1 is reduced in pressure so as to provide the evaporated gas 2 having a low pressure (secondary pressure) usable in the consuming installation 3. The cabinet cylinder 1 has the cooling means 10 and the state change monitoring means 11 installed thereto.

An air cooling system of blowing air into the cabinet cylinder 1 or a liquid cooling system of cooling the outer periphery of the cabinet cylinder 1 with a liquid is applicable as the cooling means 10. And, a thermometer, pressure gage, hygrometer or thermostat is usable as the state change monitoring means 11.

The evaporated gas supply method according to the present invention is effective in a case where (a) the primary pressure of an evaporated gas when filled in a cabinet cylinder 1 exceeds $P_{hmax}$ and (b) the enthalpy thereof at the primary pressure when filled in a cabinet cylinder 1 is less than $h_{2SC}$, (namely, in a case where an evaporated gas having a primary pressure is adiabatically expanded as it is and as a result, its liquefaction is caused to take place).

At first, accordingly, it must be done to judge whether the state of the evaporated gas 2 in the cabinet cylinder 1 satisfies the above conditions (a) and (b). In a case where these conditions are satisfied, the cabinet cylinder 1 is cooled down by the cooling means 10 because the evaporated gas will be liquefied, if it is adiabatically expanded as it is. By this cooling of the cabinet cylinder 1, the evaporated gas 2 having the primary pressure goes down along the saturated vapor line. At that time, the change of state of the evaporated gas 2 caused by the cooling means 10 is alwys monitored by means of the state change monitoring means 11, and the detection of this state will be continued until its enthalpy reaches $h_{2SC}$. As to the detecting method, it may be satisfactorily carried out to detect the enthalpy of the evaporated gas 2 directly or to detect its pressure or temperatue that exhibits indirectly the state of enthalpy. After the enthalpy of the evaporated gas 2 has reached the desired state, the evaporated gas 2 in the cylinder cabinet 1 is fed to the expansion valve 5, where its pressure is reduced for derivery to the consuming installation 3.

Owing to the abovementioned construction, the present invention can reliably prevent the liquefaction of an evaporated gas in an expansion valve from taking place. In particular, in a case where a device (such as a regulator) which undergoes any bad influence by an evaporated gas containing several percent of liquid is placed downstream of the expansion valve, the present invention is more effective.

In the abovementioned embodiment, a case where the evaporated gas is adiabatically expanded in one stage has been described as one example. However, the present invention is also applicable to a case where the adiabatic expansion of an evaporated gas is carried out in plural stages. In this case, an evaporated gas must be cooled down so that the enthalpy of the evaporated gas before a final adiabatic expansion is carried out reaches $h_{2SC}$.

For instance, in a case where when an evaporated gas is adiabatically expanded in two stages, the enthalpy is evitably increased by $\Delta h$=5 (kcal/kg) between the first-stage adiabatic expansion and second-stage adiabatic expansion under the condition of $_{2SC}$=155 (kcal/kg) and $h_1$=148 (kcal/kg), the aimed enthalpy should be 150 (kcal/kg) that is obtained by subtracting $\Delta h$ from $h_{2SC}$. Therefore, the cabinet cylinder will be statisfactorily cooled down so that the state of the evaporated gas before it is adiabatically expanded becomes at least 150 (kcal/kg).

Figure 9:
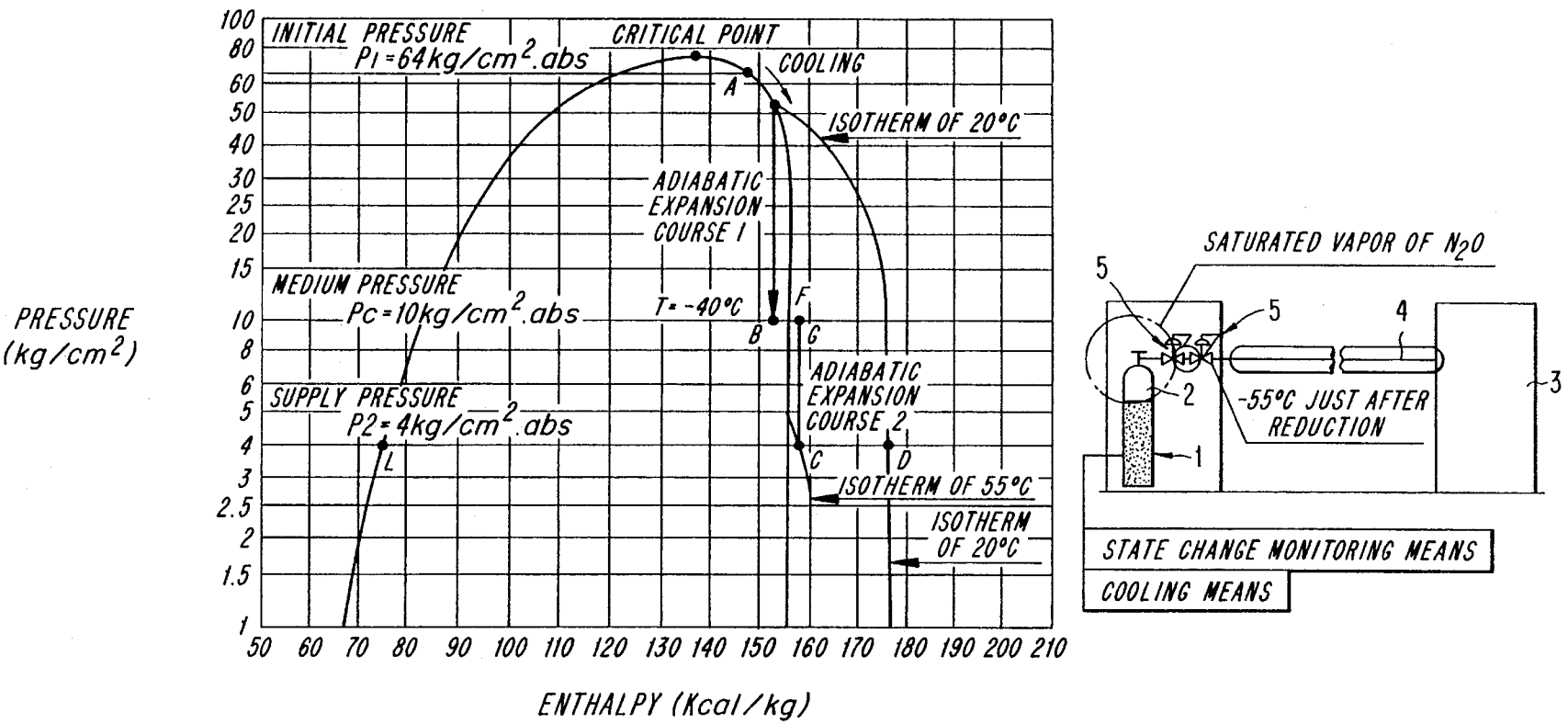
FIG. 9 is a view showing a change of state when $N_2O$ filled in a cabinet cylinder 1 whose internal pressure is 30° C. is reduced in pressure from an initial pressure P1=64 kg/cm$^2$.abs (Point A) to a medium pressure PC=10 kg/cm$^2$.abs (Point B) and a supply pressure P2=4 kg/cm$^2$.abs (Point C) by two expansion valves 5.
Figure 10:
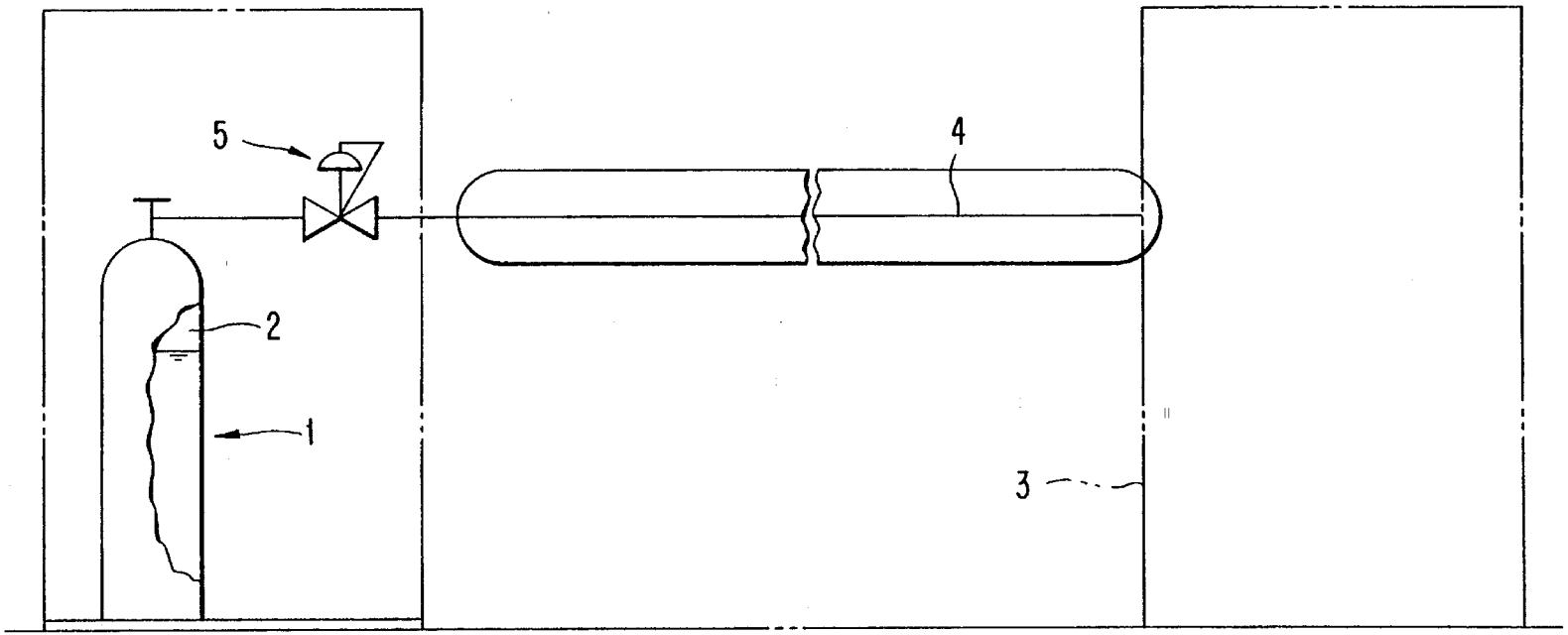
FIG. 10 is a view showing the outline of the evaporation and supply apparatus of the prior art.
Figure 11:
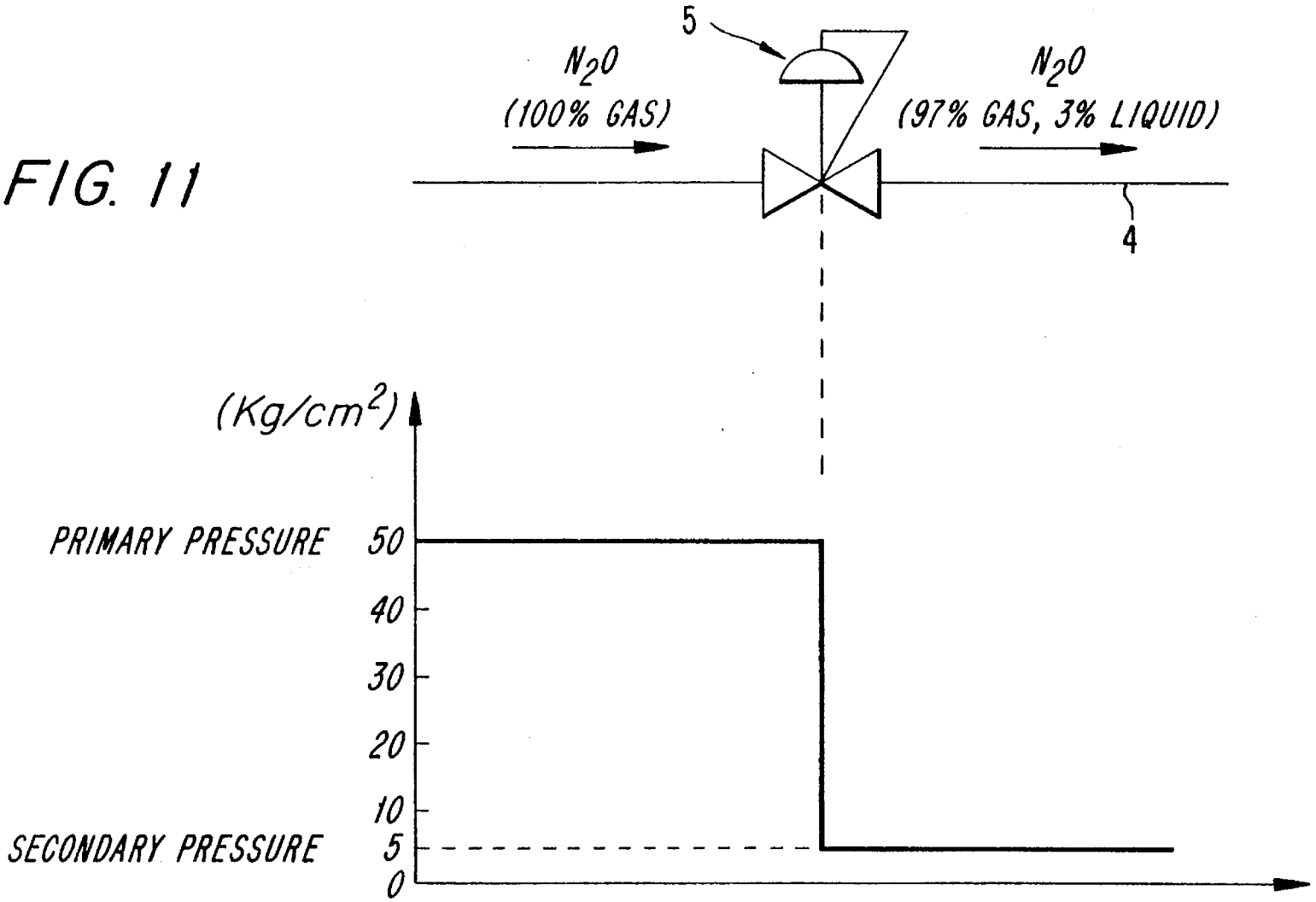
FIG. 11 is a view showing the change of pressure in the expansion valve.

FIG. 9 shows a change of state when $N_2O$ filled in a cabinet cylinder 1 whose internal temperature is 30° C. is reduced in pressure from an intitial pressure P1=64 kg/cm$^2$.abs (Point A) to a supply pressure P2=4 kg/cm$^2$.abs (Point C) by two expansion valves 5. The evaporated gas is cooled down so that its first enthalpy $h_1$ becomes over ($h_{2SC}-\Delta h$), as mentioned above. Then, the evaporated gas 2 is reduced in pressure to a medium pressure PC=10 kg/cm$^2$.abs by the first expansion valve so that its enthalpy value is increased by $\Delta h$ until it is fed to the final expansion valve, and it is further reduced in pressure to a supply pressure P2=4 kg/cm.abs by the final expansion valve. Although the temperature of the evaporated gas is lowered to about −55° C. due to its adiabatic expansion in the final pressure reduction, no liquefaction of the gas is caused to take place even by the adiabatic expansion because Point C is right of the saturated vapor line, i.e. positioned in the reagion of superheated vapor.

In addition, the present invention is not limited to the above embodiment and various modifications can be made to the present invention. Although an expansion valve is used as the device which makes an adiabatic expansion of gas in this preferred embodiment, another means can be used, not limited to the expansion valve, if it has a function of making the adiabatic expansion of gas.

Although this preferred embodiment has been desribed as one example of $N_2O$, the present invention is also applicable to an evaporated gas (such as HCl) in which the critical temperature is near to room temperature, the vapor pressure at room temperature is higher and the flow rate is larger.

EFFECTS OF THE INVENTION

The present invention is constructed as desribed above, and therefore, it is possible to effectively prevent the liquid seal of an evaporated gas from taking place.

I claim:

1. An evaporated gas supply method in which an evaporated gas having a primary pressure filled in a cylinder is reduced in pressure to a secondary pressure through adiabatic expansion, with the evaporated gas having the secondary pressure being supplied to a predetermined consuming installation, which method comprises a first step of cooling the gas in the cylinder to a temperature whereby the enthalpy of the gas in the cylinder corresponds to the secondary pressure of the gas achieved upon adiabatic expansion such that liquefaction of the gas after adiabatic expansion to such secondary pressure does not occur; and a second step of adiabatically expanding the evaporated gas filled in the cylinder so that its pressure is reduced to the secondary pressure, and supplying the evaporated gas having the reduced secondary pressure to said consuming installation.

2. The evaporated gas supply method of claim 1, wherein the state of enthalpy of the gas in the cylinder is monitored by detecting the temperature and/or pressure of the gas in the cylinder.

3. The evaporated gas supply method of claim 1, wherein the evaporated gas is $N_2O$.

4. The evaporated gas supply method of claim 1, wherein the evaporated gas in the cylinder is cooled by cooling the cylinder.

5. The evaporated gas supply method of claim 1, wherein the adiabatic expansion is achieved by use of an expansion valve.

6. The evaporated gas supply method of claim 1, wherein the adiabatic expansion is carried out in plural stages.

* * * * *